US006411259B1

(12) United States Patent
Wendt et al.

(10) Patent No.: US 6,411,259 B1
(45) Date of Patent: Jun. 25, 2002

(54) AUTOMOBILE ANTENNA DEVICE

(75) Inventors: Dirk Wendt, Metzingen; Günter Lipka, Deizisau; Werner Jäger, Hohenems, all of (DE)

(73) Assignee: Richard Hirschmann GmbH & Co., Neckartenzlingen (DE)

( * ) Notice: Subject to any disclaimer, the term of this patent is extended or adjusted under 35 U.S.C. 154(b) by 0 days.

(21) Appl. No.: 09/701,333

(22) PCT Filed: Mar. 23, 1999

(86) PCT No.: PCT/EP99/01980

§ 371 (c)(1),
(2), (4) Date: Nov. 27, 2000

(87) PCT Pub. No.: WO99/62136

PCT Pub. Date: Dec. 2, 1999

(30) Foreign Application Priority Data

May 25, 1998 (DE) ..... 198 23 202

(51) Int. Cl.[7] ..... H01Q 1/32
(52) U.S. Cl. ..... 343/713; 343/906
(58) Field of Search ..... 343/700 MS, 713, 343/906, 702

(56) References Cited

U.S. PATENT DOCUMENTS

| | | | | |
|---|---|---|---|---|
| 4,623,207 A | | 11/1986 | Sasaki et al. | |
| 4,873,532 A | | 10/1989 | Sakurai et al. | |
| 5,293,177 A | | 3/1994 | Sakurai et al. | |
| 5,363,114 A | * | 11/1994 | Shoemaker et al. | 343/828 |
| 5,867,128 A | * | 2/1999 | Sauer | 343/713 |
| 5,986,613 A | * | 11/1999 | Weber | 343/713 |
| 5,999,134 A | * | 12/1999 | Dishart et al. | 343/713 |
| 6,232,926 B1 | * | 5/2001 | Nguyen et al. | 343/713 |

FOREIGN PATENT DOCUMENTS

| | | |
|---|---|---|
| DE | 2 328 167 | 12/1974 |
| DE | 2 328 168 | 12/1974 |
| EP | 0 791 975 A2 | 8/1997 |

* cited by examiner

*Primary Examiner*—Tan Ho
(74) *Attorney, Agent, or Firm*—Fulbright & Jaworski

(57) ABSTRACT

The invention relates to an antenna device having at least one antenna structure (5–10) fixed to a vehicle window (3). The base point terminal connections of each antenna have contact points (11) which form a termination panel (4) surrounded by a base (1) arranged on the vehicle window (3) in which a radio frequency device (2) can be removably fixed, whose connection terminals maybe connected to contact points (11) without using any connecting lines.

26 Claims, 3 Drawing Sheets

28
19
28
25
23
32
33
1
28
20
26
29
29
24
28
30
36
45
36
45
43
2
37
43
46
45
12
46
45
38
35
19
36
45
2
46
45
43
37
12
46
45
38

AUTOMOBILE ANTENNA DEVICE

BACKGROUND OF THE INVENTION

1. Field of the Invention

The invention relates to a motor vehicle antenna device.

2. Description of the Related Technology

An example of one such motor vehicle antenna device is disclosed in DE 37 19 692C2. One version of its practical implementation is for Mercedes Benz passenger cars of series W 210, wherein a radio frequency device, which contains matching circuits and amplifiers, is attached to the body. The device is connected via cables to contact sites of the antenna structure(s) located on the edge of the window. The cables are either detachably plugged into or permanently soldered the contact sites of the window and to the radio frequency device.

These contacts must compensate for all tolerances between the body and the front or rear window of the vehicle, which are connected by flexible cement. These tolerances are due to shaking movements of the vehicle, and form in the production of contacts, installation of the window and radio frequency device.

The contact sites of the antenna structures are produced, among others, as a silver print relative to the window edge of the window relative to the body. The tolerances of the contact sites of the antenna structures dictate relatively large contact surfaces which are unfavorable in terms of radio frequency technology.

The antenna parameters are influenced by the laying of the connecting cables. The terminal impedance of the antenna is especially influenced by which on the input side high tolerances, which must likewise be balanced, arise, in the radio frequency device. Moreover, all the solder on the vehicle window is a problem. The solder leads to high glass fracture rates as a result of pre-stress and poor thermal conductivity of the glass, and thus makes the system more expensive.

EP 0 386 678B1 furthermore discloses attaching active quadripoles. The quadripoles are intended to be connected to the antenna structures by soldering or cementing securely on the vehicle window. In this arrangement, tolerances between the vehicle window and the body need not be balanced. In addition, no vibration tolerances need to be balanced between the two when the vehicle is moving. This is due to the lack of motion of the radio frequency device relative to the body of the vehicle.

This prior art device is not suited for the repairs or replacement of the radio frequency device, because of the need for unsoldering and resoldering the repaired or replaced radio frequency device or the need to completely replace of the window is necessary.

In addition, it is necessary to connect the quadripole to the antennas by line and solder connections. The line and solder connections result in increased cost and the aforementioned danger of window breakage.

SUMMARY OF THE INVENTION

An object of the invention is to devise a vehicle antenna device in which the radio frequency device can be detachably fastened to the window as simply and economically as possible. Moreover, this device can be connected electrically to the connection sites of the antenna structure(s) without connecting lines and without soldering.

This object is achieved by the present invention. The tolerances and relative movements between the body and the window are insignificant due to the detachable arrangement of the radio frequency device to the vehicle window. Additionally, only the tolerances of the silver print, which are one order of magnitude less, need be balanced and thus replacement of the devices can be done easily and promptly. This is advantageous because it can be done for repair purposes or for use of different radio frequency devices matching to the altered conditions. In addition, it is also possible to provide the same base for a series of vehicles, and to then equip depending on the vehicle type or antenna type. The base may be equipped with a matching radio frequency device with an external form which is always the same with reference to secure holding, as matched to the base, and its contact schematic corresponds to the configurations of the respective connection sites.

The device as claimed in the invention is thus much more versatile compared to the described prior art. Additionally, changing the device does not require expensive replacement of the window.

Various electronic components can be used as the radio frequency device and matched to the requirements of the individual case. Generally, it is an amplifier with a matching circuit. However, when only a small window surface (which does not interfere with the view of the driver) is available, a circuit may be connected to a receiver or transmitter via a ribbon cable. This connection can either be a direct connection, or one via an amplifier mounted on the body of the car.

Furthermore, the radio frequency device, for example an amplifier, can therefore be connected directly, i.e., without a connecting line to the antenna base point. This is beneficial for both independently matching the structure of the vehicle and for reception, where optimal signal/noise ratio is achieved at the amplifier output. A matching element is not necessary in the case of transmission due to the direct connection of the radio frequency device to the antenna structure(s). Optimal transmitter power is available by matching the amplifier output to the base point impedances of the antenna structures transformed to the contact sites.

Advantageous versions and embodiments of the vehicle antenna device according to the invention are set forth and claimed herein.

For electrical connection of the radio frequency device to the contact points of the antenna structure(s) there is an especially simple version which is economical to produce involving direct connection of the device terminals to the contact sites. The base need not have any contact devices, and simply serve as a holding device, and thus can be produced extremely economically as a simple injection molding.

An alternative solution for the electrical connection of the radio frequency device and the antenna(s) involves direct connection of the device terminals installed in the base to the contact cites. This solution is more complex, due to the additional contacts in the base, but offers great diversity of structural configuration versions. There are possibilities of adaptation to different spatial circumstances.

By combining the contact points of several antenna structures which have been impressed on the windshield, for example for several frequency ranges and/or diversity reception, in a terminal panel of small area, the already low silver print tolerances are further reduced. According to the invention, the contact sites can be limited to a relatively small area (unlike as in the prior art, where according to DE 37 19 692L2, they are arranged around the entire vehicle window) thereby lowering cost. In this way the size of the base and the resulting adverse effect on vision can be minimized or the base can be located in an advantageous manner, for example under moldings of the vehicle.

Here it is especially favorable to execute the feeder lines from the base points of the antenna structures to the contact sites of the termination panel by coplanar lines. Coplanar lines can be easily produced and transmit good electrical data. The production of the coplanar lines with the silver printing of the antenna structures is especially economical and precise. This also applies to the markings which are provided for the positioning of the base. These markings enable prompt and accurately positioned attachment of the base on the vehicle window, which in turn allows exact assignment of the contacts of the radio frequency device to the contact sites and thus reliable contact-making for holding of the radio frequency device in the base. A series of technical approaches are possible for holding the device. A version which is simple in structure and production uses inwardly projecting projections on the frame of the base and corresponding outwardly projecting lugs on the radio frequency device to allow the device to be held in the base after installation.

Preferably the radio frequency device is pushed into the base until the lugs of the radio frequency device which project to the outside have been fully inserted under the projections of the base frame.

Advantageously the projections and lugs are located on three corresponding sides of the base or the radio frequency device. With this location, the radio frequency device—especially when the projections on each frame side are made continuous—can be inserted into a type of pocket of the base.

To do this, sufficient space on the insertion side on the order of the insertion path, is necessary. One preferred installation of the base is in the edge area of the vehicle window, although generally there is not enough room available. For this case it is a better idea to interrupt the projections on the side opposite the insertion side. In other words, to provide several projections on each of the three sides. This embodiment is advantageous and saves material. The radio frequency device is inserted first perpendicular to the surface of the base into the letter, the lateral lugs of the radio frequency device sliding between the lateral projections of the base, and then inserted perpendicularly thereto into the base until it stops, whereby all lugs lie under the pertinent projections.

In the first installation step, the radio frequency device simply projects by roughly the depth of the projections beyond the insertion side. This embodiment is especially well suited for installation on the window edges because of the smaller space requirement.

The invention provides that the radio frequency device be held by means of a detachable catch holder. Advantageously, in the mounted state it is resistant to vibration. It is especially simple and economical to make this catch, both with respect to production and also operation. The snap-in pins with the catch cams can be produced without additional cost, as, for example, in an injection molding process (preferably together with the base).

The catch cams are pressed down when the radio frequency device is inserted into the base. When the radio frequency device has been fully inserted (as a result of the spring action of the snap-in pins) they snap back into their initial position, thus fitting behind the housing of the radio frequency device. On the other hand, by pressing down the catch cams, the radio frequency device can be easily dismounted and pulled out of the base.

Insertion of the radio frequency device into the base is greatly facilitated by the slide bevels provided on the lugs and projections which correspond to the facing ends. In many cases it is enough to bevel either only the projections or only the lugs. However, when producing the base and the housing of the radio frequency device, in an injection molding process, for example, the lugs and the projections can be produced without added costs with the corresponding profiles.

A detachable electrical connection of the terminals of the radio frequency device to the pertinent contact sites of the antenna structures on the vehicle window is done in one especially advantageous embodiment of the vehicle antenna device according to the invention by contact springs which are attached to the radio frequency device. They ensure not only permanently secure contact, which can be released if necessary without any effort, but at the same time press their lugs by their spring force against the bottom of the projections which accommodate the spring force. Both sufficient contact pressure and thus vibration-proof contact-making as well as prevention of rattling noise are achieved by suitable shaping and choice of the material of the contact springs in an extremely simpler manner.

Another possibility for increasing the contact pressure of the contact springs on the contact sites without added cost is to provide the lugs and/or projections with another bevel towards the housing of the radio frequency device. When the radio frequency device has been fully inserted into the base, the lugs, and thus the contact springs attached to the radio frequency device, are pressed further towards the vehicle window by the second slide bevel. Basically the contact springs can be attached anywhere on the surface of the radio frequency device facing the base; they need simply to lie exactly opposite the corresponding contact sites of the antenna structures. When the contact springs are aligned in a line, simple and accurate positioning is achieved. An example is alignment between the projections on the wide side (contact side) of the base.

When the contact springs are arched in their lengthwise direction, therefore the insertion direction, the result is advantageous. Making arched contact springs results in spot and thus defined contact with high contact pressure, and also allows careful sliding into the silver print of the contact points. In turn, repeated removal and insertion of a radio frequency device into and out of the base is more secure. Alternatively, if the contact springs are arched in their transverse direction in addition to moving the radio frequency device and thus the contact springs in their lengthwise direction, advantageous convex arching in this transverse direction results.

The contact springs could consist of conductive plastic in the form of plastic pads (due to their short length the electrical resistance is still relatively low) or of metal coated plastic. Metal springs have the advantage of higher stability or fracture safety, greater possible contact pressures and better conductivity. In addition, they can be produced in any shape more easily and economically than punched bending parts.

One embodiment of the contact springs is especially suited for electrical connection to circuit boards and retention in potted boards. In this embodiment, leaf springs are made roughly u-shaped with a flat leg which is mechanically and elastically connected in the radio device (preferably on a circuit board) and a convexly-arched leg which adjoins under pressure the contact sites. If the flat leg is under than the arched leg.

The execution is characterized by high mechanical stability and a large solder area for simple and reliable contact-making on the circuit board.

For exact positioning of the flat spring arm on the board for the soldering and optionally the potting or extrusion coating process, it is especially advantageous to provide the free end of the flat leg with a bent projection which is inserted into an assigned recess of the circuit board for mounting.

As protection against mechanical damage and weather effects it is advantageous to provide the radio frequency device with a housing. To reliably prevent short circuits it comprises insulating material. Production is especially economical when the housing comprises extrusion coating or potting material. This housing can be produced easily in all possible forms, without additional costs, with retaining lugs, and does not require special holding means for the injected parts (such as for example the contact spring. Furthermore, the housing can be produced especially flat, enabling hidden installation under moldings of the vehicle such as the head liner, the hat rack or the C column covering.

Another advantage of a plastic cast housing is that additional devices, for example holding or guiding means, such as molded-in cable receivers for feeder lines of other antennas (cellphone antennas or GPS navigation antennas) can be integrated essentially without additional costs in production.

The radio frequency device is not tied to the size of the base with respect to its dimensions. Rather it can also project easily over the base with parts which have no contacts, if the holding force of the lugs which fit behind the projections of the base is sufficient.

If this is not the case, for example when an especially high vibration resistance is demanded, widening of the base beyond its terminal area assigned to the termination panel of the antenna structures is advantageous. Here the lateral projections are feasibly made as individual projections spaced apart from one another, between which the lateral lugs of the widened part of the radio frequency device are inserted, or on the third side, or there can also be a continuous projection.

The entire base can be made in several parts (but as one piece), with the advantage that only one base for the different sizes of the devices is necessary. The vehicle antenna device is thus economical and versatile because (due to this base design) different devices (for example single-stage or multistage amplifiers and passive circuits such as filters, matching circuits or remote feed means) do not require different windows.

The cementing of the base on the vehicle window is permanently secure, promptly exact, and can be done with much less effort than solder connections.

Even relatively complex radio frequency devices can be produced today with comparatively small dimensions. Nevertheless in the interest of maximum possible driving safety it is advantageous to position the base on the edge of the window. As previously mentioned, if somehow possible, place it under moldings of the vehicle or under the surfaces of the window covered by the black print.

The invention is detailed below in the figures using one embodiment of the vehicle receiving antenna device as claimed in the invention with a widened base and an amplifier.

DETAILED DESCRIPTION OF THE PREFERRED EMBODIMENTS

Figure 1:
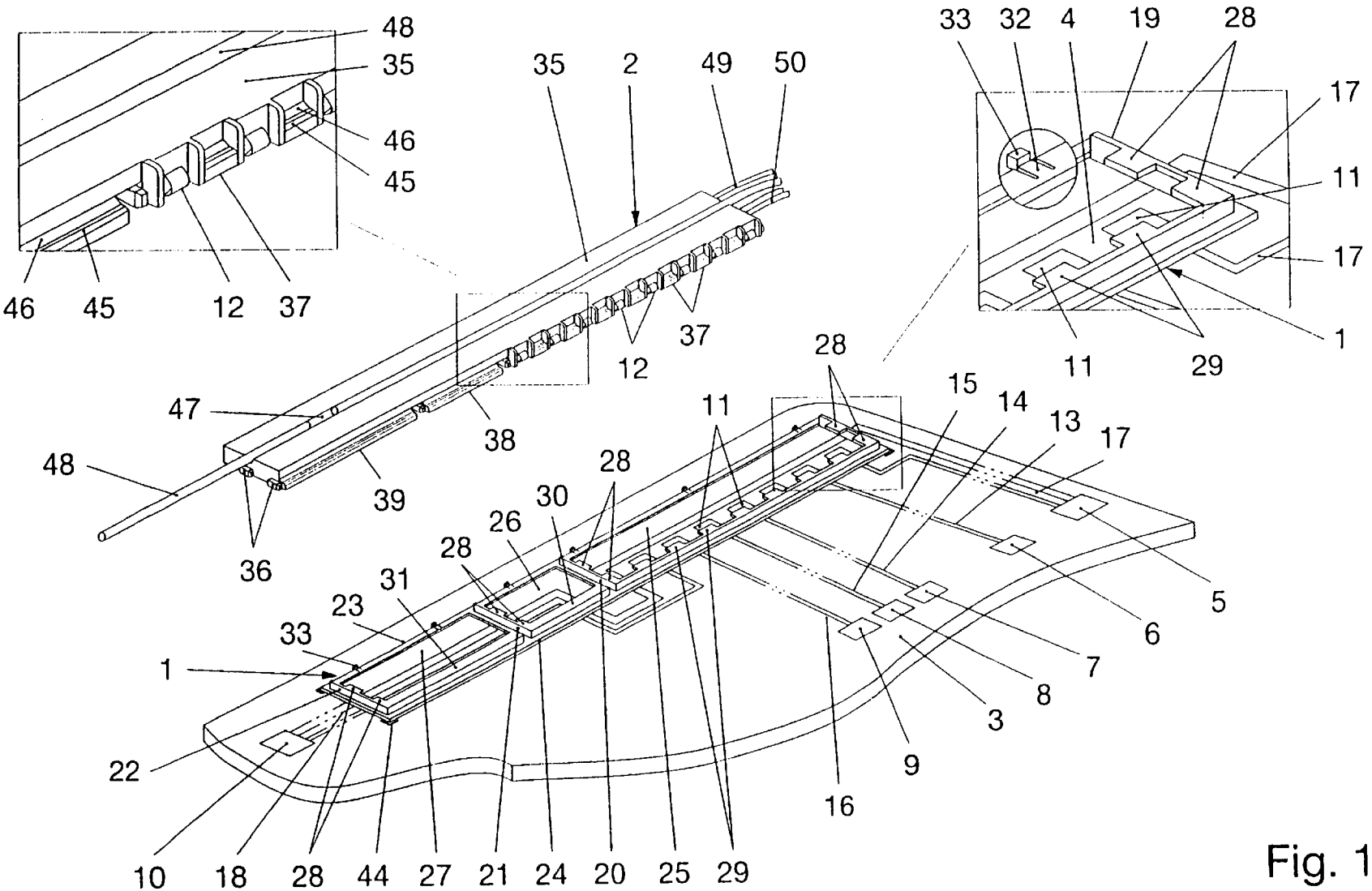
FIG. 1 shows a perspective view of a vehicle antenna device as claimed in the invention on a vehicle window with an amplifier not yet mounted in the base and two extracts on an enlarged scale, the extract of the base in one component area being enlarged even more.
Figures 2A, 2B, 2C:
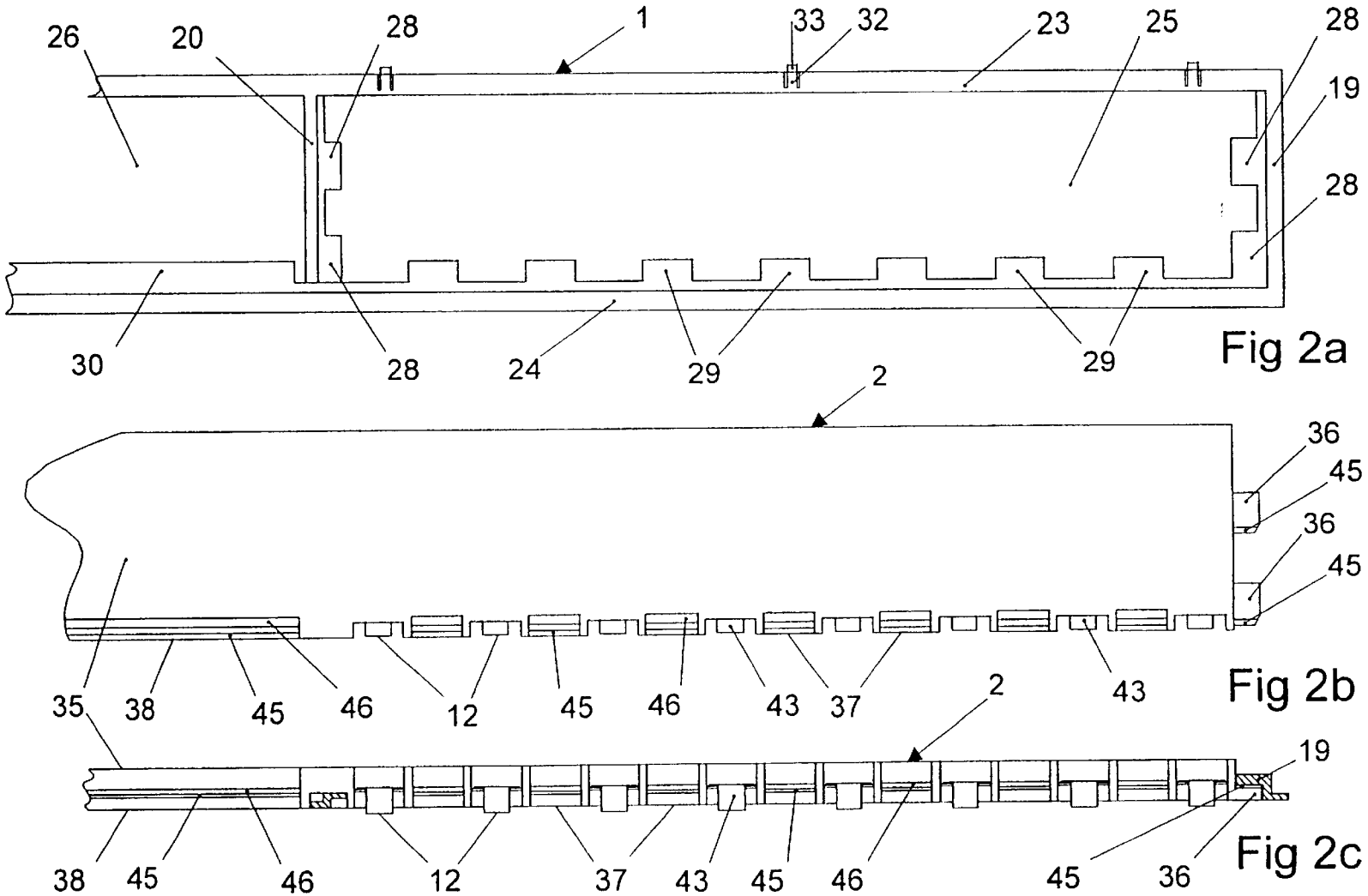
FIG. 2*a* shows an overhead view of the terminal area and an adjacent widening area of the base.
FIG. 2*b* shows an overhead view of the base parts.
FIG. 2*c* shows a section through the base at the height of the contact-side lateral projections with an end face of the amplifier.
Figure 3A:
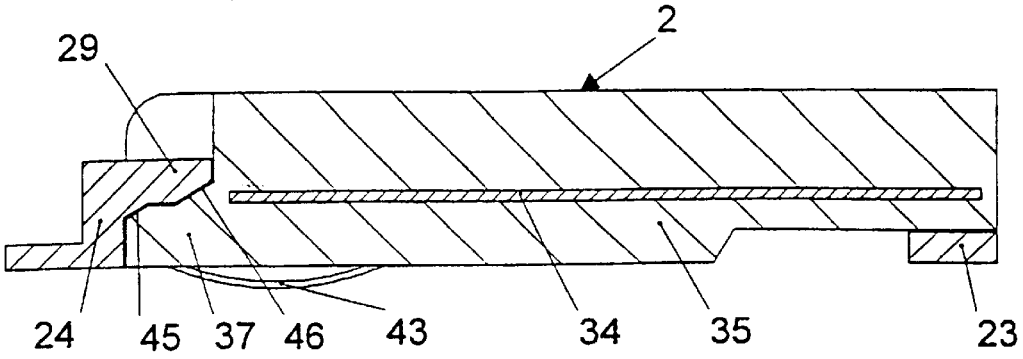
FIG. 3*a* shows a section through the amplifier in the insertion direction at the height of the contact-side projection on an enlarged scale.
Figure 3B:
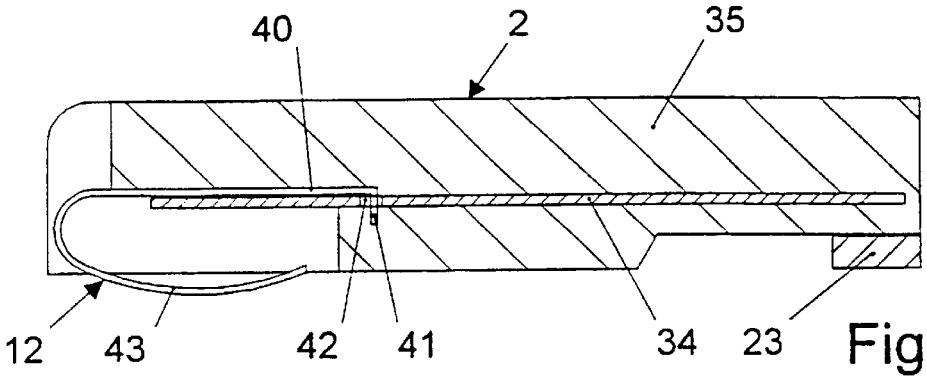
FIG. 3*b* shows a section through the amplifier in the insertion direction at the height of a contact spring.
Figure 4A:
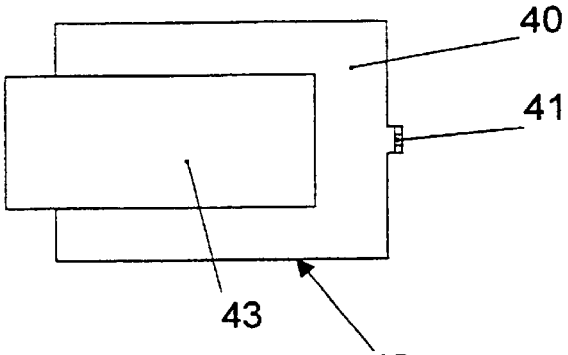
FIG. 4*a* shows an overhead view of a contact spring from the contact side of an enlarged scale.
Figure 4B:
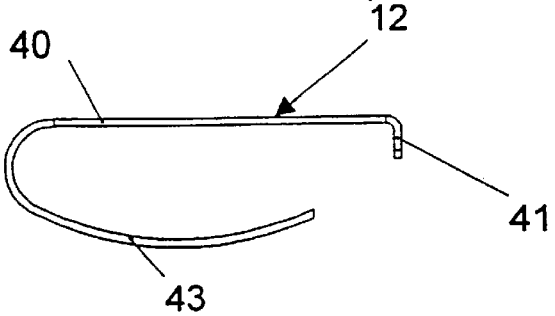
FIG. 4*b* shows a side view of the contact spring.

The vehicle antenna device intended for reception of signals in different frequency ranges comprises a base 1 which has been manufactured as an injected plastic part, a radio frequency amplifier 2 which can be inserted therein and a termination panel 4 which is located in the top right corner area of the rear window 3 of the vehicle, which has minimum area and in which the base points of several antenna structures 5–10 shown fundamentally here only as small boxes are combined in flat contact sites 11 to make contact with the assigned contact springs 12 of the radio frequency amplifier 2.

The connecting lines of the contact sites 11 with the antenna base points are made depending on length, either as simple line paths 13–16 or coplanar lines 17, 18 and to save money are applied together with the antenna structures 5–10 and the contact sites 11 in silver print to the vehicle window 3. By combining all antenna terminals advantageously only one amplifier is necessary which moreover can be located on a nondisruptive site on the vehicle window 3.

The base 1 comprises a rectangular frame with lateral frame parts 19, 20, 21 and 22 and one insertion-side and one contact-side frame part 23 and 24. Between the lateral frame parts 19 and 20 is the terminal area 25 for the radio frequency amplifier 2, between the lateral frame parts 20 and 21 and 21 and 22 there is one widening section 26 and 27 each, respectively. The lateral frame parts 19–22 each have two retaining projections 28 which project inwardly, the contact-side frame part 24 in the terminal area 7 has retaining projections 29 and in the widening sections 26, 27 one continuous retaining projection 30, 31 each. All retaining projections 28 to 31 are spaced away from the bottom of the base.

Elastic snap-in pins which end in catch cams 33 to hold the mounted radio frequency amplifier 2 are molder to the insertion-side frame part 23.

The radio frequency amplifier 2 comprises a circuit board 34 which bears the electrical circuit components and which is embedded in the injection molded housing 35 which is made and dimensioned to fit for installation in the base 1. On the two narrow sides it has two projections 36 each and on the contact side in the terminal area 25 has lugs 37 which correspond to the projections 29 of the frame part 24 of the base 1.

Two continuous lugs 38, 39 which interact with the projections 30, 31 of the widening sections 26, 27 of the base 1 are molded to the contact-side face of the section of the housing 35 which lies outside the terminal area 25.

Between the lugs 37 in the terminal area 25 are the contact springs 12 which rest with the flat part 40 on the circuit board 34, are soldered there with the corresponding terminal points and fit into a recess 42 of the circuit board 34 for mechanical fixing with a projection 41 which is bent on one end. After potting, the contact springs 12 are attached securely and relatively stable in the housing 35 in order to be able to accommodate the spring pressure when contact is made. The bent-back spring part 43 which projects downward out of the housing 35 is convexly arched as the contact leg in the lengthwise direction. To increase the stability of the contact springs the flat spring part 40 is made wider than the arched contact leg 43.

Installation of the vehicle antenna device is extremely simple:

First, using the markings 44 which are likewise applied as silver print with the antenna structures 5–10 and the contact points 11 and the connecting lines 13–18 to the vehicle window 3, the base is accurately positioned over the termination panel 4 of the contact points and cemented on the vehicle window 3 such that with the radio frequency amplifier installed the contact springs 12 rest exactly on the pertinent contact points 11.

After successful cementing, the radio frequency amplifier 2 with lateral lugs 36 is inserted into the intermediate spaces between the lateral projections 28 of the base 1 perpendicular to the plane of the window, the catch lugs 33 being pressed by the bottom of the housing towards the vehicle window 3 such that then the radio frequency amplifier 2 can be pushed in the direction to the contact-side frame part 24 until it stops.

In doing so, the lugs 36–39 of the amplifier housing 35 slide under the corresponding projections 28–31 of the base 1 and with the radio frequency amplifier pushed fully in the catch cams 33 snap up and fit behind the amplifier housing 35.

In this installed position the radio frequency amplifier 2 is thus held in the base on all sides.

The lugs 36 to 39 on their faces towards the projections 28 to 31 have slide bevels 45 which facilitate insertion of the amplifier housing 35 into the base 1.

When the radio frequency amplifier 2 is inserted into the base 1, the contact springs 12 are compressed perpendicularly to the plane of the window so that their arched contact legs 43 after sliding onto the contact sites 11 with subsequent insertion of the amplifier housing 35 under spring pressure adjoin the contact sites and establish reliable contact. Moreover, by the pressure of the contact springs 12 the opposing surfaces of the projections 28–31 and lugs 36–39 which belong together are pressed against one another, thus increasing the retaining action.

This effect is intensified even more by another bevel 46 of the lugs 36–39 which press the amplifier housing 35 which has been inserted fully onto the base 1 even further in the direction toward the vehicle window 3.

The bottom of the projections 28–31 is matched to the described contour of the lugs 37–39 with two bevels 45 and 46.

The amplifier housing 35 has a guide and retaining groove 47 which is produced in injection molding manufacture in the same step for holding a cable 48 which originates from another antenna which is not shown, for example a GPS antenna, and which does not belong to the vehicle antenna device, and is routed on to a navigation device.

The output lines of the radio frequency amplifier 2 which are also potted in the amplifier housing 35 and which lead to receivers which are not shown, for example, for broadcast reception and remote control interlock, are made as ribbon cables 49, 50 here.

Overall, with the described structure a vehicle antenna device as claimed in the invention is formed, in which the radio frequency device 2 is easily and economically mounted on the window without soldering, secure against vibration but still detachable, repair or insertion of another radio frequency device does not necessitate replacement of the window, the amplifier is very flat and thus is suited for installation under moldings of the vehicle, simply one radio frequency device is necessary for a host of antenna structures and only moreover minimum tolerances need be balanced and optimum electrical transmission data re achieved by direct connection of the radio frequency amplifier to the antenna structures.

What is claimed is:

1. A motor vehicle antenna system comprising:

at least one antenna structure having a contact site and being fixed to a vehicle window;

a base attached to said vehicle window proximal said at least one contact site; and a device having at least one terminal and being removably coupled to said base, whereby said at least one terminal is detachably electrically connected to said at least one contact site.

2. The motor vehicle antenna system of claim 1, wherein said base has base contacts disposed adjacent said contact sites, whereby said terminal is detachably electrically connected to said base contacts, and said base contacts contact said contact sites.

3. The motor vehicle antenna system of claim 2, wherein said device comprises a radio frequency device, and wherein at least a first terminal of said radio frequency devices detachably electrically connected to at least one said contact site and at least a second terminal of said radio frequency device is detachably electrically connected to at least one said base contact.

4. The motor vehicle antenna system of claim 1, wherein said device comprises a radio frequency device.

5. The motor vehicle system of claim 4, wherein said radio frequency device is held in said base by detachable catch means.

6. The motor vehicle antenna system of claim 5, wherein said catch means comprises elastic snap-in pins integrally located on a frame of said base and catch cams disposed on a back wall of a housing of said radio frequency device.

7. The motor vehicle antenna system of claim 4, wherein said terminals comprise contact elements for contacting said contact sites under pressure when said radio frequency device is installed in said base.

8. The motor vehicle antenna system of claim 7, wherein said contact elements have areas convexly arched in their length wise direction for contacting said contact sites.

9. The motor vehicle antenna system of claim 7, wherein said contact elements comprise metallic leaf springs.

10. The motor vehicle antenna system of claim 9, wherein said leaf springs are generally U-shaped and have a flat leg mechanically attached and electrically connected to said radio frequency device and have a convexly arched leg adjoining one of said contact sites under pressure when said radio frequency device is installed in said base.

11. The motor vehicle antenna system of claim 10, wherein said flat leg is wider than said arched leg.

12. The motor vehicle antenna system of claim 11, wherein said flat leg has a projection on a free end that is bent towards said arched leg for engaging a recess of a circuit board located in said radio frequency device.

13. The motor vehicle antenna system of claim 4, wherein said radio frequency device is disposed in a housing comprising insulated material.

14. The motor vehicle antenna system of claim 13, wherein said housing comprises a plastic potting mass.

15. The motor vehicle antenna system of claim 13, wherein said housing has retaining or guide devices integrated therein.

16. The motor vehicle antenna system of claim 1, wherein said at least one antenna structure comprises at least two antenna structures, and wherein the contact sites of said antenna structures form a termination panel disposed in a terminal area defined by said base.

17. The motor vehicle antenna system of claim 16, wherein each antenna structure has a feeder line disposed between a front end of said antenna structure and said contact site of said antenna structure.

18. The motor vehicle antenna system of claim 17, wherein at least one antenna structure has a plurality of feeder lines configured as coplanar lines disposed between said front end and said contact site.

19. The motor vehicle system of claim 18, wherein a marking for a desired positioning of said base is applied to said vehicle window.

20. The motor vehicle antenna system of claim 19, wherein said feeder lines, said marking, a power supply and ground lines that are routed to said contacts comprise silver printed surfaces impressed onto said vehicle window with silver print of the antenna structure.

21. The motor vehicle system of claim 1, wherein said base comprises a frame having inward projections, and wherein said radio frequency device is provided with corresponding outgoing projecting lugs configured to fit behind said projections, whereby a holding affect is exerted when said radio frequency device is installed in said base.

22. The motor vehicle antenna system of claim 21, wherein said lugs and said projections are disposed on three sides of said radio frequency device and said base.

23. The motor vehicle antenna system of claim 22, wherein end faces of at least one of said lugs or of said projections have slide bevels.

24. The motor vehicle antenna system of claim 1, wherein said base is cemented onto said vehicle window.

25. The motor vehicle antenna system of claim 1, wherein said base is positioned on said vehicle window outside the normal field of vision of a driver.

26. The motor vehicle antenna system of claim 1, wherein said device is covered by black print on an opposite side of said window.

* * * * *